United States Patent [19]

Svagr

[11] Patent Number: 4,480,454

[45] Date of Patent: Nov. 6, 1984

[54] SKEW-ROLLING MILL FOR REDUCING SOLID AND HOLLOW CROSS-SECTIONS

[75] Inventor: Alexander Svagr, Hilden, Fed. Rep. of Germany

[73] Assignee: SMS Schloemann-Siemag AG, Dusseldorf, Fed. Rep. of Germany

[21] Appl. No.: 363,479

[22] Filed: Mar. 30, 1982

[30] Foreign Application Priority Data

Apr. 3, 1981 [DE] Fed. Rep. of Germany ..... 3113461

[51] Int. Cl.[3] ..... B21B 19/02

[52] U.S. Cl. ..... 72/78

[58] Field of Search ..... 72/78, 77, 121

[56] References Cited

U.S. PATENT DOCUMENTS

| | | | |
|---|---|---|---|
| 1,368,413 | 2/1921 | Stiefel | 72/78 |
| 3,273,367 | 9/1966 | Hallden | 72/76 |
| 3,735,617 | 5/1973 | Bretschneider | 72/78 |

FOREIGN PATENT DOCUMENTS

| | | | |
|---|---|---|---|
| 2013749 | 10/1971 | Fed. Rep. of Germany | 72/78 |
| 2748770 | 5/1979 | Fed. Rep. of Germany | 72/78 |
| 2750380 | 5/1979 | Fed. Rep. of Germany | 72/78 |

OTHER PUBLICATIONS

"The Three-roll Planetary Mill, a New Reduction Machine" Bretschneider et al., 1979

*Primary Examiner*—Lowell A. Larson
*Attorney, Agent, or Firm*—Holman & Stern

[57] ABSTRACT

A skew-rolling mill for reducing solid or hollow cross-sections, in which a roll carrier and a first hollow shaft rotatably mounted therein and allowing passage of the rolled stock are supported rotatable independently of each other in a stand. The roll carrier comprises three driven conical working rolls inclined to the rolled stock axis and mounted circumferentially spaced at 120° intervals and adjustable with respect to the rolled stock axis. The shafts carrying the working rolls, whose axes cross the rolled stock axis at short distances apart, are each drivably connected to an intermediate shaft by way of a respective bevel gear pair. Each intermediate shaft also carries a spur gear which acts as an intermediate gear wheel and is engaged by way of a respective planet pinion with a sun wheel which is mounted on one end of the first hollow shaft and can be rotated in such a manner as to control the relationship between the roll rotational speed and the roll carrier rotational speed so that the rolled stock passes through the rolling mill without rotating. The roll carrier extends in the form of a second hollow shaft which is supported in two positions in the stand, and through which the first hollow shaft passes being supported in the second hollow shaft at both ends thereof. The other end of the first hollow shaft projects from the second hollow shaft and is connected in a non-rotatable manner to a drive gear wheel.

3 Claims, 2 Drawing Figures

SKEW-ROLLING MILL FOR REDUCING SOLID AND HOLLOW CROSS-SECTIONS

BACKGROUND OF THE INVENTION

This application relates to applicant's copending application Ser. No. 06/375,569, filed May 6, 1982, titled "Apparatus For Changing The Tapered Dolls Of A Skew Rolling Mill", assigned to the same assignee.

FIELD OF THE INVENTION

The invention relates to a skew-rolling mill, in which a roll carrier (rotor) and a hollow shaft, which is rotatably disposed in this latter and allows passage of the rolled stock, are rotatably supported independently of each other in a stand (stator). The driven roll carrier (rotor) is provided with three conical working rolls inclined to the rolled stock axis at 120° to each other, each being driven by way of one of three planet pinions which roll on a sun wheel mounted on the hollow shaft as the roll carrier (rotor) rotates. Such planetary skew-rolling mills have proved satisfactory both for the high deformation of semifinished products, i.e. solid cross-sections, and for the reduction of hollow cross-sections.

The working rolls are adjustable relative to the rolled stock in order to give the cross-section the required dimensions, or the hollow cross-section the required outer diameter, the inner diameter being determined by the mandrel rod.

The feed motion for the rolled stock is derived from an inclined positioning of the rolls in which the axes of the shafts carrying the working rolls cross the rolled stock axis at short distances apart. In order to be able to adjust these crossing angles, the roll heads in which the working roll shafts are supported are inserted into the roll carrier (rotor) such that they can be swivelled about axes parallel to the rolled stock axis.

In order to drive the planet pinion associated with any working roll, an intermediate shaft is supported in the roll heads parallel to the rolled stock axis, and carries an intermediate gear wheel which is engaged with the planet wheel and a bevel pinion which is engaged with a bevel gear mounted on the roll shaft.

The inclined positioning of the rolls, by means of which the feed motion of the rolled stock is determined, is conditional upon a determined relationship between the roll rotational speed and the rotor rotational speed if, for a determined roll position and a determined rolled stock diameter as defined thereby, the rolled stock is to be able to pass through the rolling mill without rotating. However, in order to prevent the rolled stock from rotating for other roll positions or inclinations, the hollow shaft is rotatable together with the sun wheel mounted thereon, and thus the relationship between the roll rotational speed and the rotor rotational speed can be controlled.

DESCRIPTION OF THE PRIOR ART

In known planetary skew-rolling mills constructed in the manner heretofore described, the provision of a stable support and the rotary drive for the two mutually separate rotatable parts, namely the roll carrier (rotor) and the hollow shaft carrying the sun wheel and provided with a passage for the rolled stock, are not without problems.

Thus, it is known to rotatably support the hollow shaft in the stand (stator), and to provide a drive gear wheel for transmitting the torque, either at one of its ends outside the two support positions, or between the two support positions. In this case, the roll carrier is either fully supported on the other end of the hollow shaft projecting from the stand (stator), i.e. by means of two bearings (as proposed in German Patent Specification DE-AS No. 16 02 153), or is supported at least by means of one bearing on this end of the hollow shaft and a second bearing in the stand (stator) (as proposed in German Patent Specification DE-OS No. 27 48 770). The hollow shaft must carry the sun wheel between a bearing for the roll carrier (rotor) on the hollow shaft and the stand (at least one bearing is necessary), the outer diameter of the hollow shaft being determined by the size of the sun wheel, whereas the inner diameter of the hollow shaft must be governed by the diameter of the rolled stock. The fact that the heavy and highly stressed roll carrier (rotor) is supported either fully or at least by one bearing on the hollow shaft means that this latter is considerably stressed, whereas the torque can only be transmitted to the roll carrier (rotor) by way of large sized drive gear wheels, which are directly connected to the roller carrier (rotor).

In a further proposed arrangement, the roll carrier (rotor) is supported by means of two bearings in the stand (stator), and the roll heads are disposed on the roll carrier (rotor) between the bearing positions, whereas the hollow shaft is rotatably disposed in the roll carrier (rotor) (the prospectus of Mannesmann Demag AG). However, the fact that the roll heads are disposed between the bearings makes the accessibility to the rolls and thus roll replacement difficult.

BRIEF SUMMARY OF THE INVENTION

An object of the invention is to improve the support for the roll carrier (rotor) carrying the roll heads, and for the hollow shaft carrying the sun wheel, in order to attain stable support with reliable torque transmission, and preservation of good accessibility to the roll heads comprising the rolls.

According to the invention, there is provided a skew-rolling mill for reducing solid or hollow cross-sections, comprising a roll carrier, a first hollow shaft rotatably mounted in the roll carrier and allowing passage of the rolled stock, a stand in which the rolls are supported rotatably independently of each other, three driven conical working rolls which are carried by the roll carrier, which are inclined to the rolled stock axis at 120° apart from each other and which are adjustable with respect to the rolled stock axis, and shafts which carry the working rolls, whose axes cross the rolled stock axis at short distances apart, and which are each drivably connected to a respective intermediate shaft by way of a respective bevel gear pair, each intermediate shaft carrying a spur gear which acts as an intermediate gear wheel and is engaged by way of a respective planet pinion with a sun wheel which is mounted on the first hollow shaft and can be rotated in such a manner as to control the relationship between the roll rotational speed and the roll carrier rotational speed so that the rolled stock passes through the rolling mill without rotating, each conical roll with its rolls shaft, the bevel gear mounted on the roll shaft, the intermediate shaft with the second bevel gear mounted thereon and the intermediate gear wheel being supported in a housing and combined into a respective roll head, the roll head being inserted into the roll carrier so that they can be swivelled about the axes of the intermediate shafts parallel to the rolled stock axis in order to adjust the angle at which the roll axis cuts the rolled stock axis, the roll carrier extending in the form of a second hollow shaft which is supported in two positions in the stand and through which the first hollow shaft passes, the first hollow shaft being supported in the second hollow shaft at both ends of the second hollow shaft, one of the ends of the first hollow shaft which project from the second hollow shaft being connected in a non-rotatable manner to a drive gear wheel, and the other being connected in a non-rotatable manner to the sun wheel.

The dimensions (diameter and length) of the second hollow shaft can be such as to reliably ensure the strived-for stable support, even though free access from the front end of the rolling mill to the roll carrier and the roll heads carried thereby is maintained.

Desirably, the bearings which support the first hollow shaft in the second hollow shaft are disposed within bearings by which the second hollow shaft is supported in the stand.

Although the construction according to the invention makes it possible to provide a large sized drive gear wheel for the roll carrier (rotor) and to couple this directly to the roll carrier, the fact that the roll carrier extends in the form of a second hollow shaft readily makes it possible, to dispose the drive gear wheel for the roll carrier (rotor) between the two bearings of the second hollow shaft, and to connect it in a non-rotatable manner to the second hollow shaft, as the diameter of the second hollow shaft can be freely chosen to take into consideration the stress due to the torque. By disposing the drive gear wheel between the bearings, the overall axial extension of the roll carrier can be limited to the minimum necessary for accommodating the roll heads, and the reduction gearing for the drive gear wheel can be solidly supported in the stand (stator).

BRIEF DESCRIPTION OF THE DRAWINGS

One embodiment of the invention will now be described by way of example with reference to the accompanying drawings, wherein.

DETAILED DESCRIPTION

Figure 1:
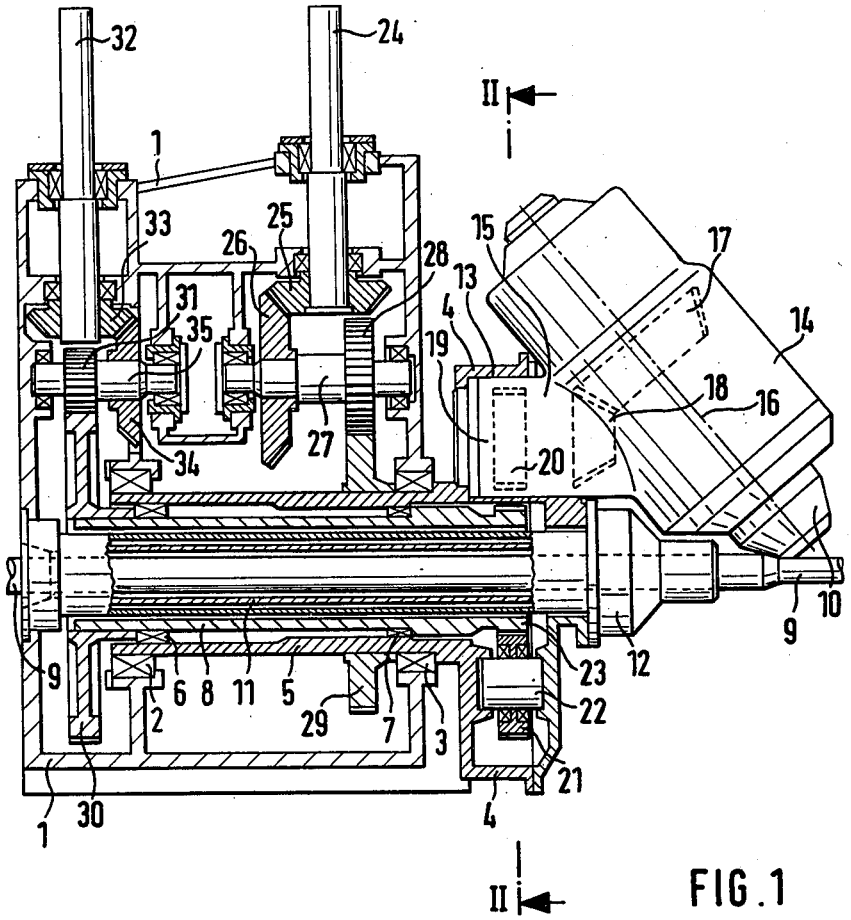
FIG. 1 is a cross-sectional view taken on the line I—I of FIG. 2.
Figure 2:
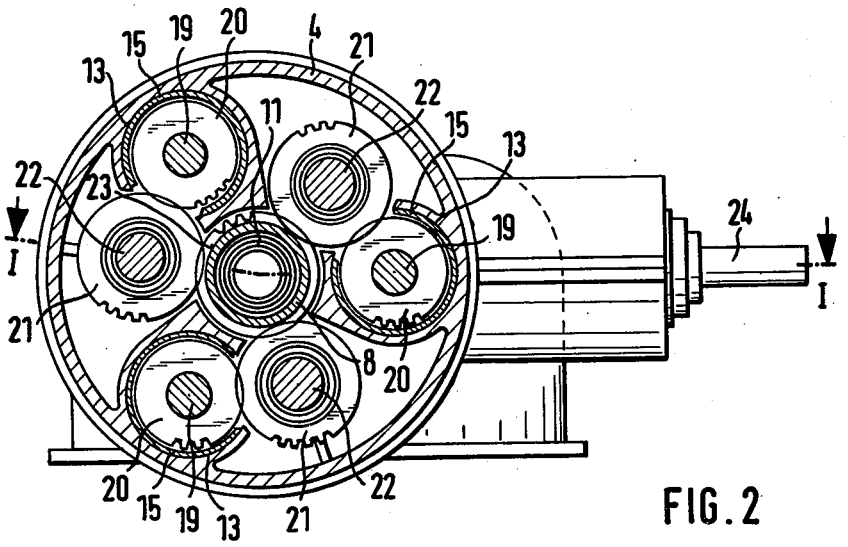
FIG. 2 is a cross-sectional view on the line II—II of FIG. 1.

The reference numeral 1 indicates the stand—also known as the stator—of a skew-rolling mill, in which the hollow shaft 5 of the roll carrier 4—also known as the rotor—is rotatably supported in bearings 2 and 3. In this outer second hollow shaft 5, there is rotatably supported in bearings 6 and 7 an inner first hollow shaft 8, which ensures passage of the rolled stock 9 to the inclined conical rolls 10, the inner first hollow shaft 8 being protected against heat radiation from the rolled stock 9 by a double-walled cooled tube 11 which surrounds the rolled stock 9, and is fixed at one of its ends in the stand 1 and supported in the rotating roll carrier 4 at its other end by means of a bearing 12.

The roll carrier 4 is provided with three bores 13 formed from the front end and running parallel to the rolled stock axis. A roll head housing 14 is inserted by way of its cylindrical appendage 15 into each of the bores 13 so that it can be swivelled and fixed in position. A shaft 16 carrying a roll 10 and rotated by a bevel gear 17 is supported in each of the roll head housings 14. The roll shafts 16 together with the rolls 10 are axially adjustable. Bevel pinions 18, each of which is rotatably connected to an intermediate gear wheel 20 by means of a respective intermediate shaft 19, engage with the bevel gears 17. On inserting the roll heads 14 with their appendages 15 into the bores 13 in the roll carrier 4 the intermediate gear wheels 20 come into engagement with planet pinions 21 which are rotatably supported in the roll carrier 4 on pivots 22. The planet pinions 21 are also engaged with a sun wheel 23 which is mounted in a rotatably rigid manner on the inner first hollow shaft 8. A bevel gear 25 is rotated by a drive motor, not shown, by way of a shaft 24, and in its turn rotates a bevel gear 26, a shaft 27 and a gear wheel 28. The gear wheel 28 engages with a gear wheel 29, mounted in a rotatably rigid manner on the outer second hollow shaft 5 which is joined to the roll carrier 4, so that this latter is likewise rotated. By this means, the planet pinions 21 roll on the sun wheel 23, so that the rolls 10 are rotated by way of the intermediate gear wheels 20, the intermediate shafts 19, the bevel pinions 18 and the bevel gears 17 with their shafts 16, and thus carry out the rolling operation on the rolled stock 9. The axes of the rolls 10 cross the rolled stock axis at short distances apart. This inclined positioning of the rolls 10 generates the feed motion and determines the reduction of the rolled stock by means of the rolls 10. The rolled stock diameter, the roll diameter and roll rotational speed must be in a determined relationship to each other if the rolled stock is to pass through the rolling mill without rotating. In order to prevent rotation of the rolled stock when rolling under other relationships, the inner first hollow shaft 8 is correspondingly rotated with the sun wheel 23 mounted thereon. For this purpose, a drive gear wheel 30 is mounted in a rotatably rigid manner on the first hollow shaft 8, and is engaged with a pinion 31. A speed-controlled auxiliary motor, not shown, rotates the shaft 32 together with the bevel gear 33 mounted thereon, the bevel gear 34 engaged therewith, the pinion shaft 35 and the pinion 31 and drive gear wheel 30, to thus rotate the first hollow shaft 8 and its sun wheel 23 at the required rotational speed.

I claim:

1. A skew-rolling mill for reducing solid or hollow cross-sectional rolled stock, comprising: a stand; a roll carrier having a second hollow shaft extending therefrom rotatably supported in two positions in said stand; a first hollow shaft rotatably mounted within and supported at both ends of said second hollow shaft to facilitate axial passage of the rolled stock therethrough; three roll head housings mounted on said roll carrier; three driven conical working rolls each rotatably mounted on a respective roll head housing at 120° circumferentially spaced intervals with their axes of rotation inclined with respect to and crossing at a short distance apart the longitudinal axis of the rolled stock, said conical working rolls being adjustable in the direction of their axes of rotation with respect to said axis of the rolled stock and each being mounted on a separate roll shaft rotatably mounted in a respective housing; a bevel gear mounted on each roll shaft; an intermediate shaft rotatably mounted in each respective housing with its axis of rotation parallel to said rolled stock axis; a bevel gear mounted on each intermediate shaft operatively engaging a respective one of said roll shaft bevel gears; an intermediate spur gear mounted on each intermediate shaft; a sun gear on one end of said first hollow shaft; three pinion shafts rotatably mounted on said roll carrier; a planetary pinion gear mounted on each pinion shaft and operatively engaging a respective intermediate spur gear and said sun gear; each respective housing, conical roll, roll shaft, roll shaft bevel gear, intermediate shaft, intermediate bevel gear and intermediate spur gear forming an integrated removable roll head assembly; means to adjustably and removably mount said roll head assemblies on said roll carrier so that each assembly can be rotatably adjusted about the axis of its respective intermediate shaft to adjust the angle at which its respective roll axis crosses said rolled stock axis comprising, a hollow cylindrical extension integral with and extending from each roll head housing having a circular peripheral outer surface extending axially toward said roll carrier, said intermediate spur gear being totally within said extension, a slot in said peripheral outer surface in a position and having a size to allow the radially outer portions of said intermediate spur gear and a respective one of said planetary pinion gears to penetrate into to facilitate meshing engagement thereof, three bores in said roll carrier extending parallel to the axis of rotation of said roll carrier and having their axes circumferentially spaced at 120° intervals, each of said bores removably and rotatably receiving an extension of a roll head housing, and a slot through the wall of each bore positioned and having a size to allow at least the radially outer peripheral portion of a respective one of said planetary pinion gears to penetrate into to facilitate said meshing engagement with a respective intermediate spur gear, a drive gear wheel non-rotatably connected to the other end of said first hollow shaft which projects from the respective end of said second hollow shaft; drive means to rotate said second hollow shaft; and drive means operatively engaging said drive gear wheel to rotate said sun gear in a manner to control the relative rotational speed of said rolls and said roll carrier so that said rolled stock passes through the rolling mill without rotating.

2. A skew-rolling mill as claimed in claim 1 and further comprising: first bearings rotatably supporting said first hollow shaft in said second hollow shaft; and second bearings supporting said second hollow shaft in said stand; said first bearings being disposed substantially within said second bearings.

3. A skew-rolling mill as claimed in claim 1 and further comprising bearings supporting said second hollow shaft at said two positions, wherein said two positions are in spaced relationship with respect to each other, and said drive means to rotate said second hollow shaft includes a second drive gear wheel mounted on said second hollow shaft between said bearings.

* * * * *